US007799187B2

(12) United States Patent
DiMilia et al.

(10) Patent No.: US 7,799,187 B2
(45) Date of Patent: Sep. 21, 2010

(54) INERT ELECTRODE ASSEMBLIES AND METHODS OF MANUFACTURING THE SAME

(75) Inventors: Robert DiMilia, Greensburg, PA (US); Frankie Phelps, Apollo, PA (US); Lance M. Sworts, New Kensington, PA (US)

(73) Assignee: Alcoa Inc., Pittsburgh, PA (US)

( * ) Notice: Subject to any disclaimer, the term of this patent is extended or adjusted under 35 U.S.C. 154(b) by 882 days.

(21) Appl. No.: 11/566,080

(22) Filed: Dec. 1, 2006

(65) Prior Publication Data

US 2008/0128273 A1 Jun. 5, 2008

(51) Int. Cl.
*C25B 11/03* (2006.01)
*C25B 11/04* (2006.01)

(52) U.S. Cl. ..... 204/284; 204/280; 204/286.1; 204/291; 204/292; 204/293; 204/243.1; 204/245; 29/745; 29/746

(58) Field of Classification Search ..... 204/280, 204/284, 286.1, 291, 292, 293, 243.1, 245; 29/745, 746

See application file for complete search history.

(56) References Cited

U.S. PATENT DOCUMENTS

| | | | | |
|---|---|---|---|---|
| 3,960,678 | A | 6/1976 | Alder | 204/67 |
| 4,057,480 | A | 11/1977 | Alder | 204/290 R |
| 4,764,257 | A | 8/1988 | Sadoway | 204/1 T |
| 6,126,799 | A | 10/2000 | Ray et al. | 204/291 |
| 6,248,227 | B1 | 6/2001 | de Nora et al. | 205/230 |
| 6,423,195 | B1 | 7/2002 | Ray et al. | 204/291 |
| 6,551,489 | B2 | 4/2003 | D'Astolfo et al. | 205/389 |
| 6,558,526 | B2 | 5/2003 | D'Astolfo et al. | 205/389 |
| 6,805,777 | B1 | 10/2004 | D'Astolfo et al. | 204/280 |
| 6,818,106 | B2 | 11/2004 | D'Astolfo et al. | 204/243.1 |
| 6,855,234 | B2 | 2/2005 | D'Astolfo et al. | 204/280 |
| 6,878,246 | B2 | 4/2005 | Latvaitis et al. | 204/280 |
| 2005/0164871 | A1* | 7/2005 | Latvaitis et al. | 502/101 |
| 2005/0199508 | A1* | 9/2005 | D'Astolfo et al. | 204/280 |

* cited by examiner

*Primary Examiner*—Bruce F Bell
(74) *Attorney, Agent, or Firm*—Greenberg Traurig, LLP

(57) ABSTRACT

A composite anode assembly is provided, the assembly including a permeation resistant portion and a porous conductive portion circumscribing at least the bottom of the permeation resistant portion. The composite anode assembly reduces corrosion and restricts thermal expansion stresses.

33 Claims, 2 Drawing Sheets

INERT ELECTRODE ASSEMBLIES AND METHODS OF MANUFACTURING THE SAME

FIELD OF THE INVENTION

The present invention relates to composite inert electrode assemblies including both a permeability resistant portion and a porous conductive portion. The present invention also relates to methods of producing such inert electrode assemblies.

BACKGROUND OF THE INVENTION

Aluminum is produced conventionally by the well-known Hall-Héroult process, which generally involves dissolving alumina in a molten bath of cryolite and passing current through the bath to reduce the alumina to aluminum. Current is generally passed through the bath via an anode assembly positioned within the bath.

For many years, carbon anodes were typically employed in aluminum electrolysis cells. More recently, inert anodes have been developed in which ceramic or ceramic-metal materials are generally used in place of carbon. Various known inert anode structures and materials are disclosed in U.S. Pat. No. 6,126,799 to Ray et al., U.S. Pat. No. 6,423,195 to Ray et al., U.S. Pat. No. 6,551,489 to D'Astolfo et al., U.S. Pat. No. 6,805,777 to D'Astolfo, U.S. Pat. No. 6,818,106 to D'Astolfo et al., U.S. Pat. No. 6,855,234 to D'Astolfo et al., and U.S. Patent Application Publication 20040198103 to Latvaitis et al., each of which are incorporated herein by reference in their entirety.

One existing technique utilized to create inert anodes is press-sintering. In this technique, a metal-oxide containing powder (e.g., an iron oxide and/or nickel oxide containing powder) is pressed and sintered at high temperature to create a dense monolith. Press-sintering is useful in producing relatively small inert anodes, but has various drawbacks in the production of relatively large anodes. Some difficulties that arise with press sintering large anodes include low and/or non-uniform densities, and an inability to economically produce irregular shapes. Thus, a relatively large number of relatively small inert anodes are generally used in electrolytic cells, thereby increasing capital costs associated with aluminum electrolysis cells.

Other issues associated with inert anodes includes thermal shock and corrosion. Thermal shock occurs during when the anode is subject to significant temperature gradients (e.g., during cell start-up). For example, some inert anodes may crack if subjected to a temperature gradient of greater than about 50° C. Thus, inert anodes are typically preheated prior to immersion in the electrolyte bath. Inert anodes may also corrode during cell operation, thereby contaminating the electrolyte bath.

There exists a need for larger-scale inert anode assemblies that are resistant to thermal shock and corrosion.

SUMMARY OF THE INVENTION

In view of the foregoing, a broad objective of the present invention is to provide larger size inert anodes and methods of making the same.

A related objective is to provide inert anodes that are resistant to cracking and/or corrosion during operation.

In addressing one or more of the above objectives, the present inventors have recognized that a composite anode assembly may be utilized. Particularly, the present inventors have recognized that press-sintering is useful for small bodies, but is undesirable for large bodies due to the densities issues that arise. The present inventors have further recognized that other methods of producing dense monolith bodies, such as fused casting, slip casting and extrusion, are generally useful for small bodies, but are generally economically unfeasible for larger bodies due to the intense engineering, manufacturing and labor costs that arise, especially with respect to complex and/or irregular shapes.

The present inventors have further recognized that casting technology readily facilitates the production of large, complex shapes ("casts"). Casts have a higher porosity than bodies produced by press-sintering (i.e., a lower density) making them more adaptable to thermal changes than monolithic bodies, but casts are incapable of protecting the electrical conductor pin of the anode by themselves.

In one aspect of the invention, an inventive anode assembly is provided, the anode assembly comprising a permeation resistant portion (e.g., a press-sintered monolith) adapted to circumscribe an electrical conductor pin and a porous conductive portion (e.g., a cast body) circumscribing the permeation resistant portion. The permeation resistant portion may be any suitable permeation resistant body free of continuous interconnected porosity closed cell adapted for operation as an anode in an inert anode assembly. By way of illustration, the permeation resistant portion may be a press-sintered monolith having a specific density range, thereby making it substantially impermeable to molten electrolyte. The permeation resistant portion may have a density of at least about 85 wt %, such as at least 90 wt % and/or at least about 95 wt % of its theoretical density. Generally the permeability resistant portion will have a density that is not greater than 98% of theoretical density.

The permeation resistant portion may include any suitable material adapted to function in an anode setting. By way of illustration, the permeation resistant portion may include one or more of iron oxide (ferric or ferrous), nickel oxide and/or zinc oxide. For example, the permeation resistant portion may comprise a press-sintered monolith, such as described in U.S. Pat. No. 6,805,777 to D'Astolfo, Jr., which is hereby incorporated herein by reference in its entirety.

The porous conductive portion may be any suitable body adapted to resist cracking during rapid temperature changes and is adapted for operation in the inert anode assembly (e.g., is relatively electrically conductive). For example, the porous conductive portion may comprise similar materials to those used in production of the permeation resistant portion. Generally, the porous conductive portion has an electrical conductivity of at least about 5 $ohm^{-1}cm^{-1}$ and thermal coefficient of expansion similar to thermal coefficient of expansion of the permeation resistant portion. The permeation resistant portion generally may have a porosity of at least 10%, such as at least 15%, and not greater than 40%, such as not greater than 30%.

As noted, the permeation resistant portion is adapted to circumscribe an electrical conductor pin. Hence, in one embodiment of the present invention, an anode assembly including an electrical conductor pin is provided, the electrical conductor pin being circumscribed by a permeation resistant portion, which is circumscribed by a porous conductive portion. The electrical conductor pin may be any suitable conductor pin useful with inert anode assemblies. Suitable electrical conductor pins include those made from nickel, nickel alloys (e.g., INCONEL), copper, copper alloys and corrosion-protected steel.

The present invention also provides for electrolysis cells including a plurality of composite anode assemblies. The composite anode assemblies may include any of the above-described features. In one embodiment, the anode assembly is utilized in an aluminum electrolysis cell, wherein an electric current is passed through the anode assembly, through the electrolyte bath and to a cathode to facilitate production of aluminum.

Methods for producing the inventive anode assemblies are also provided. One embodiment of a method useful in accordance with the present invention includes the steps of forming a permeation resistant portion, forming a porous conductive portion, and interconnecting the permeation resistant portion to the porous conductive portion. The permeation resistant portion may be formed by, for example, press sintering. The porous conductive portion may be formed by various methods, such as casting. In one embodiment, the method comprises creating a porous conductive precursor, flowing the porous conductive precursor into a mold, and firing the porous conductive precursor to form the porous conductive portion. The method may also include the steps of inserting the permeation resistant portion into the mold prior to the firing step. In this embodiment, the interconnecting step comprises the steps of inserting the permeation resistant portion into the mold and firing the porous conductive portion precursor.

These and other aspects, advantages, and novel features of the invention are set forth in part in the description that follows and will become apparent to those skilled in the art upon examination of the following description and figures, or may be learned by practicing the invention.

DETAILED DESCRIPTION

Reference will now be made in detail to the accompanying drawings, which at least assist in illustrating various pertinent embodiments of the present invention.

Figure 1:
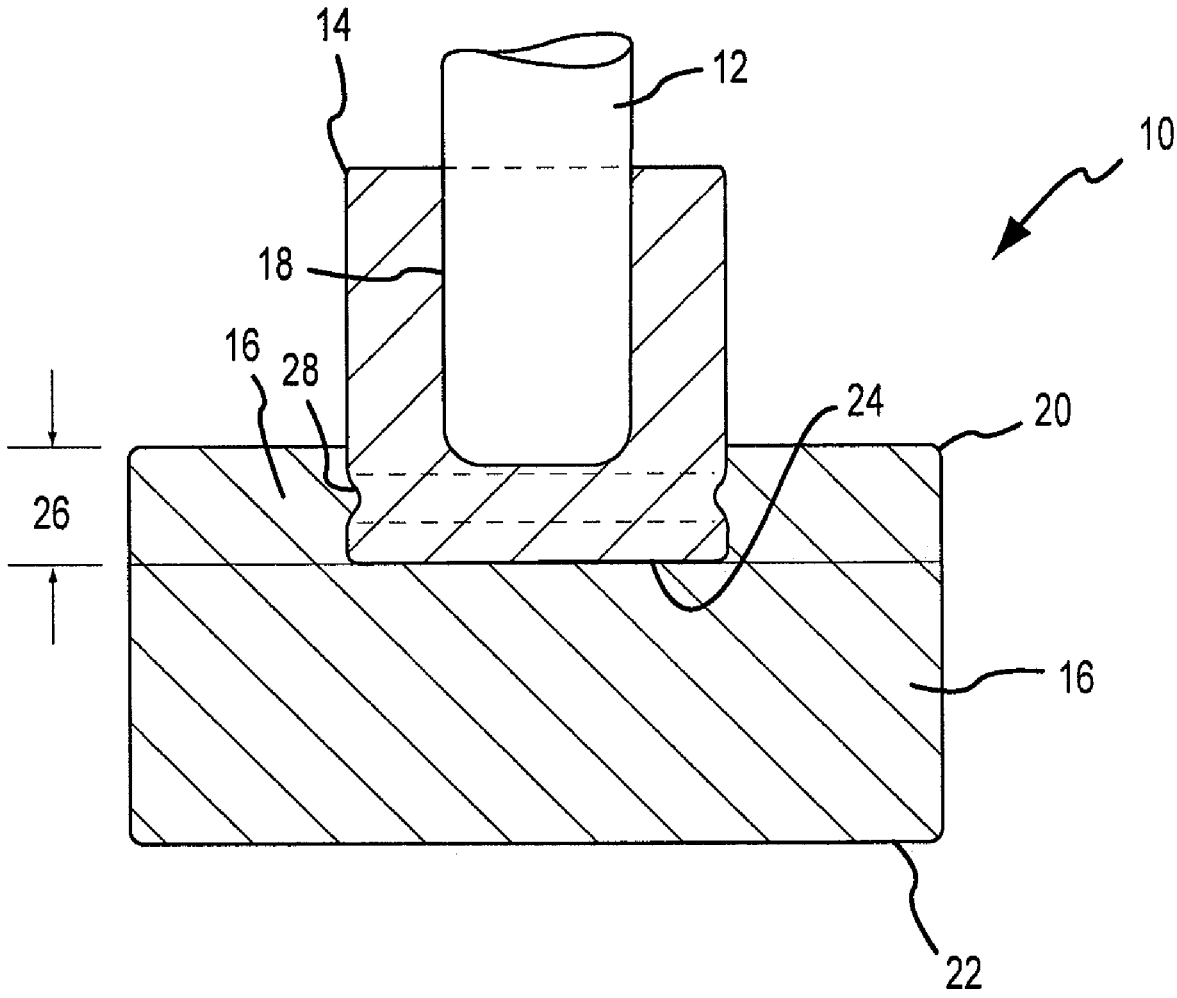
FIG. 1 is a cross-sectional view of one embodiment of a composite anode useful in accordance with the present invention.

One embodiment of an anode assembly useful in accordance with the present invention is illustrated in FIG. 1. The anode assembly 10 comprises an electrical conductor pin 12, interconnected to a permeation resistant portion 14, which is interconnected to a porous conductive portion 16. The permeation resistant portion 14 circumscribes at least a portion of the electrical conductor pin 12, and the porous conductive portion 16 circumscribes at least a portion of the permeation resistant portion 14. In the illustrated embodiment, the electrical conductor pin 12 has a circular cross-section and has a bottom portion 18 that is circumscribed/surrounded by the permeation resistant portion 14. In the illustrated embodiment, the porous conductive portion 16 circumscribes the bottom 24 and a portion of the sides of the permeation resistant portion 14.

For purposes of illustration, the anode assembly of FIG. 1 will now be described by referring to the permeation resistant portion 14 as a monolith and the porous conductive portion 16 as a cast body. However, is it to be understood that such references are for purposes of illustration only and are not meant to limit the invention in any regard.

The monolith 14 is generally made by pouring metal oxide materials around a mandrel the size of the electrical conductor stud/pin, all enclosed inside a flexible mold, such as high strength polyurethane. Pressure is then exerted on the outside of the flexible mold, such as by isostatic pressing at from about 20,000 psi to 40,000 psi (137,800 kPA to 206,700 kPa) to form a consolidated compressed part having a density of from 85% to 98% of theoretical density, making it essentially impermeable to molten mixtures. The mandrel may then be removed and an electrical conductor stud inserted with subsequent sintering of the pin and monolith, as taught in U.S. Pat. No. 6,855,234 to D'Astolfo et al.

The cast body 16 may be prepared in any suitable manner. For example, the cast refractory 16 may be prepared from a dry mixture that has been mixed with a suitable liquid solvent, such as water, and subsequently heated, such as in a mold. As may be appreciated, the mold may comprise any number of specific dimensions and features. Thus, various shapes, regular and irregular, and of a relatively large size, can be produced. The cast body 16 may be made from conductive metal oxides, such as ion and nickel oxides.

The anode assembly 10 of the present invention can be prepared in a variety of manners. For instance, a porous conductive precursor may be poured into a mold, followed by insertion of the monolith 14 to a predetermined depth 26 within the mold. The mold may then be heated to cast and surround the monolith 14. Optionally, the poured mixture can be subjected to vibratory forces to facilitate removal of gases entrained within the liquid material prior to heating. The cast body 16 may include one of a groove or ring and the monolith 14 may include the other of a ring or groove 28 to facilitate attachment between the cast body 16 and monolith 14. It is anticipated that the permeation resistant portion will have dimensions similar to conventional inert anodes (e.g., about a 6" diameter and height of about 10"). The porous conductive portion is expected to have similar dimensions to conventional carbon anodes (e.g., 2'×4'×1.5').

Figure 2:
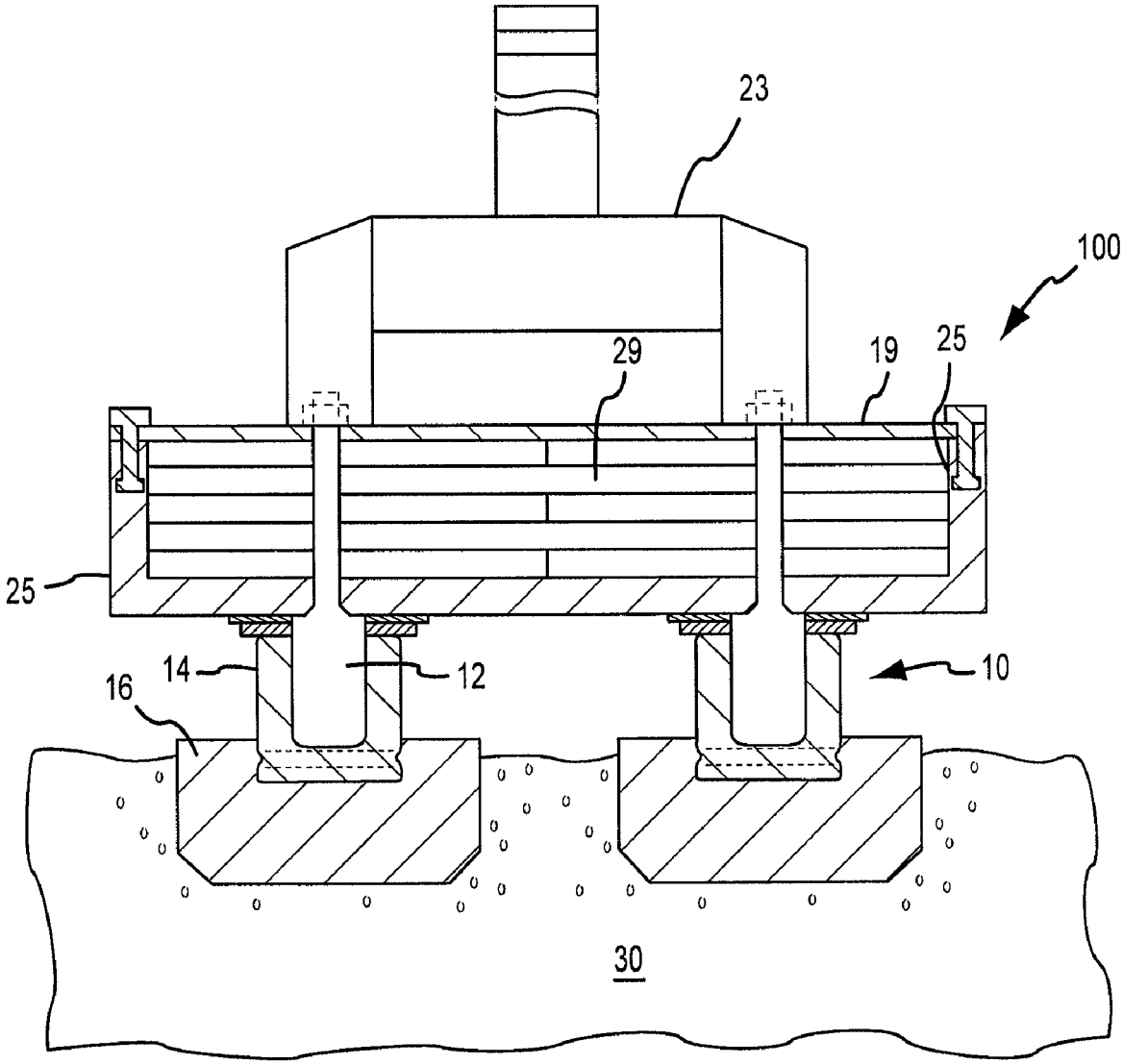
FIG. 2 is a cross-sectional view of a plurality of composite anodes in an electrolysis cell.

The anode assembly 10 may be utilized in any number of electrolytic cell environments. For example, the anode assembly 10 may be used in aluminum electrolysis cell. One example of such aluminum electrolysis cell is illustrated in FIG. 2, which illustrates an aluminum electrolysis cell 100 comprising an anode assembly 10. The electrolysis cell 100 includes a top support structure 23 interconnected to a plurality of anode assemblies 10, the anode assemblies being adapted to pass current through a molten electrolyte 30. The top support structure 23 can include a holder 25 to which the anode assemblies are attached. The holder 25 can be a flat structure, or, for example, a hollow box-type structure, as illustrated, filled with insulation 29. Metal bolts may anchor the anode assemblies 10 to a top anchor, such as steel plate 19. As may be appreciated, any number of anode assemblies 10 may be used in the electrolysis cell 100, as appropriate per application.

While the invention is described in terms of certain specifics and embodiments, the claims herein are intended to encompass all equivalents within the spirit of the invention. Furthermore, while the present invention has been described relative to an anode assembly, it will be appreciated that the present teachings may also be applied to certain cathode assemblies.

What is claimed is:

1. An electrode assembly for use in an electrolytic cell, the electrode assembly comprising:

an electrically conductive permeation resistant portion adapted to circumscribe an electrical conductor pin;

wherein the electrically conductive permeation resistant portion comprises a metal oxide; and a porous conductive portion circumscribing at least a bottom portion of the electrically conductive permeation resistant portion.

2. The electrode assembly of claim 1, wherein the electrically conductive permeation resistant portion comprises a density of at least about 85% of its theoretical density.

3. The electrode assembly of claim 1, wherein the electrically conductive permeation resistant portion comprises a density of not greater than 98 wt % of its theoretical density.

4. The electrode assembly of claim 1, wherein the metal oxide is selected from the group consisting of iron oxides, zinc oxides, nickel oxides, and mixtures thereof.

5. The electrode assembly of claim 1, wherein the porous conductive portion comprises a porosity of not greater than 40%.

6. The electrode assembly of claim 1, wherein the porous conductive portion circumscribes bottom and sides of the electrically conductive permeation resistant portion.

7. The electrode assembly of claim 1, wherein the porous conductive portion comprises a metal oxide.

8. The electrode assembly of claim 7, wherein the metal oxide is selected from the group consisting of iron oxides, zinc oxides, nickel oxides, and mixtures thereof.

9. The electrode assembly of claim 1, wherein the electrically conductive permeation resistant portion and the porous conductive portion have at least one metal oxide in common.

10. The electrode assembly of claim 1, wherein the electrically conductive permeation resistant portion comprises one of a ring and groove on the exterior surface thereof and wherein the porous conductive portion comprises the other of a ring and groove on the exterior surface thereof.

11. The electrode assembly of claim 1, further comprising:

an electrical conductor pin circumscribed by the electrically conductive permeation resistant portion.

12. An electrolysis cell comprising the electrode assembly of claim 1.

13. The electrode assembly of claim 1, wherein the electrically conductive permeation resistant portion comprises a density of at least about 90% of its theoretical density.

14. The electrode assembly of claim 1, wherein the electrically conductive permeation resistant portion comprises a density of at least about 95% of its theoretical density.

15. An electrode assembly for use in an electrolytic cell, the electrode assembly consisting essentially of:

an electrical conductor pin;

an electrically conductive permeation resistant portion circumscribing the electrical conductor pin;

wherein the electrically conductive permeation resistant portion comprises a metal oxide; and a porous conductive portion circumscribing at least a bottom portion of the electrically conductive permeation resistant portion.

16. An electrolysis cell comprising the electrode assembly of claim 15.

17. A method for forming a composite anode assembly, the method comprising:

forming an electrically conductive permeation resistant portion, wherein the electrically conductive permeation resistant portion comprises a metal oxide;

inserting at least a portion of an electrical conductor pin into the electrically conductive permeation resistant portion;

flowing a porous conductive precursor into a mold;

firing the porous conductive precursor to form a porous conductive portion; and interconnecting the electrically conductive permeation resistant portion to the porous conductive portion.

18. The method of claim 17, wherein the interconnecting step comprises inserting the electrically conductive permeation resistant portion into the mold prior to the firing step.

19. The method of claim 18, wherein the porous conductive portion comprises one of a ring and a groove and the electrically conductive permeation resistant portion comprises the other of the ring and the groove, the ring being disposed with the groove.

20. An electrode assembly for use in an electrolytic cell, the electrode assembly comprising:

an electrically conductive permeation resistant portion adapted to circumscribe an electrical conductor pin; and a porous conductive portion circumscribing at least a bottom portion of the electrically conductive permeation resistant portion;

wherein the electrically conductive permeation resistant portion comprises one of a ring and groove on the exterior surface thereof, and wherein the porous conductive portion comprises the other of a ring and groove on the exterior surface thereof.

21. The electrode assembly of claim 20, wherein the electrically conductive permeation resistant portion comprises a density of at least about 85% of its theoretical density.

22. The electrode assembly of claim 20, wherein the electrically conductive permeation resistant portion comprises a density of at least about 90% of its theoretical density.

23. The electrode assembly of claim 20, wherein the electrically conductive permeation resistant portion comprises a density of at least about 95% of its theoretical density.

24. The electrode assembly of claim 20, wherein the electrically conductive permeation resistant portion comprises a density of not greater than 98 wt % of its theoretical density.

25. The electrode assembly of claim 20, wherein the electrically conductive permeation resistant portion comprises a metal oxide.

26. The electrode assembly of claim 25, wherein the metal oxide is selected from the group consisting of iron oxides, zinc oxides, nickel oxides, and mixtures thereof.

27. The electrode assembly of claim 20, wherein the porous conductive portion comprises a porosity of not greater than 40%.

28. The electrode assembly of claim 20, wherein the porous conductive portion circumscribes bottom and sides of the electrically conductive permeation resistant portion.

29. The electrode assembly of claim 20, wherein the porous conductive portion comprises a metal oxide.

30. The electrode assembly of claim 29, wherein the metal oxide is selected from the group consisting of iron oxides, zinc oxides, nickel oxides, and mixtures thereof.

31. The electrode assembly of claim 20, wherein the electrically conductive permeation resistant portion and the porous conductive portion have at least one metal oxide in common.

32. The electrode assembly of claim 20, further comprising:

an electrical conductor pin circumscribed by the electrically conductive permeation resistant portion.

33. An electrolysis cell comprising the electrode assembly of claim 20.

* * * * *